US006386761B1

(12) United States Patent
Bohnsack

(10) Patent No.: US 6,386,761 B1
(45) Date of Patent: May 14, 2002

(54) CHILDREN'S BEDDING TOTE AND METHOD OF CONSTRUCTION

(76) Inventor: Jennifer L. Bohnsack, 6438 Riverview La., Dallas, TX (US) 75248

( * ) Notice: Subject to any disclaimer, the term of this patent is extended or adjusted under 35 U.S.C. 154(b) by 0 days.

(21) Appl. No.: 09/374,459

(22) Filed: Aug. 13, 1999

Related U.S. Application Data

(60) Provisional application No. 60/096,506, filed on Aug. 14, 1998.

(51) Int. Cl.[7] ..... B65D 33/06

(52) U.S. Cl. ..... 383/24; 383/40; 383/907; 5/419; D6/601

(58) Field of Search ..... 383/4, 10, 907, 383/38, 24, 39, 40; 5/417, 418, 419, 420; D6/588, 589, 601

(56) References Cited

U.S. PATENT DOCUMENTS 2,898,609 A * 8/1959 Storie ..... 5/419
3,041,638 A * 7/1962 Lo Vico ..... 190/2 X
3,052,895 A * 9/1962 Lo Vico ..... 383/4 X
3,222,695 A * 12/1965 Brown ..... 5/417
4,194,601 A * 3/1980 Yellin ..... 190/2
4,316,287 A * 2/1982 Rule ..... 5/419
4,754,512 A * 7/1988 Chao-Yang ..... 5/419 X
4,774,734 A * 10/1988 Mills ..... 5/413 R
4,967,428 A * 11/1990 Browder ..... 5/419
5,093,947 A * 3/1992 Henegar et al. ..... 5/419
5,110,219 A * 5/1992 Lopes ..... 190/2 X
5,172,440 A * 12/1992 Ming ..... 5/417 X
5,421,045 A * 6/1995 Bowen ..... 5/485
5,481,767 A * 1/1996 Lewis ..... 5/417
5,644,807 A * 7/1997 Battistella ..... 5/419
5,774,912 A * 7/1998 Dominque ..... 383/4 X
5,778,468 A * 7/1998 Saarela et al. ..... D6/601 X
5,920,931 A * 7/1999 Zuehlke et al. ..... 5/419
5,996,146 A * 12/1999 McPherson ..... 4/413 R

OTHER PUBLICATIONS

*Leaps and Bounds,* Premier Edition, D. A Pillow–A Pal–A Pajama Tote, Too . . . Pertinent Pages Not Indicated, Fall 1998.

Oriental Trading Company, Inc., 1998 Holiday Catalog #164E, 15"×36" Plush Pillow Covers and Puppets . . . Pertinent Pages not Indicated, 1998.

* cited by examiner

*Primary Examiner*—Jes F. Pascua
(74) *Attorney, Agent, or Firm*—Baker Botts L.L.P.

(57) ABSTRACT

A children's bedding tote is disclosed. The children's bedding tote (10) comprises a tote cover (12) having an aesthetic shape (16) and a handle (20). A pillow (18) is disposed within the tote cover (12). The tote cover (12) is also operable to receive a children's blanket (11).

14 Claims, 5 Drawing Sheets

FIG. 1d
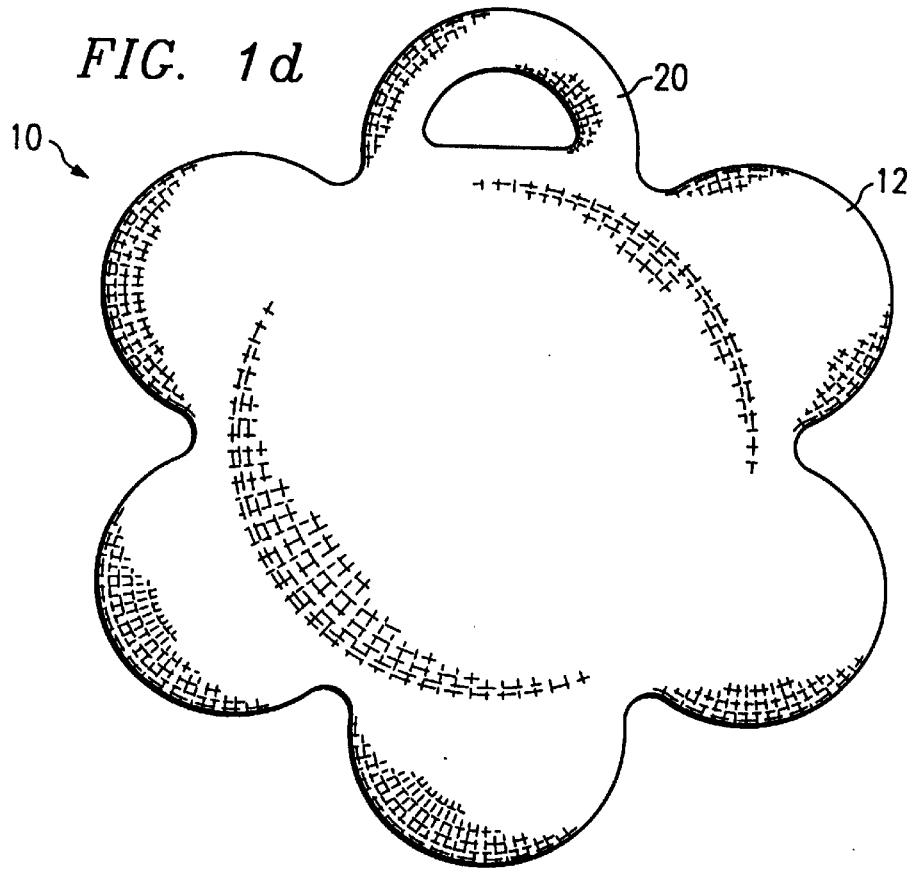
FIG. 1e
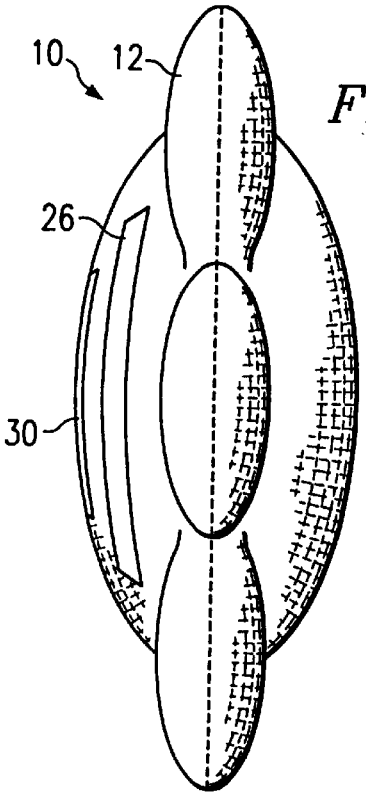
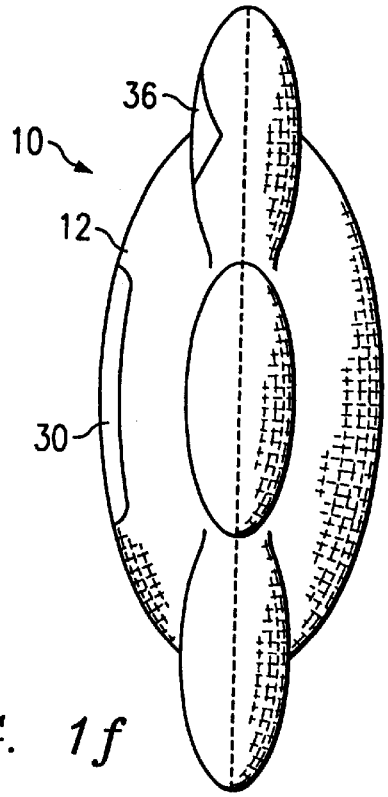
FIG. 1f

CHILDREN'S BEDDING TOTE AND METHOD OF CONSTRUCTION

RELATED APPLICATION

This application claims the benefit of U.S. Provisional Application No. 60/096,506, filed Aug. 14, 1998.

TECHNICAL FIELD OF THE INVENTION

This invention relates generally to the field of children's accessories, and more particularly to a children's bedding tote and method of construction.

BACKGROUND OF THE INVENTION

Many children between the ages of two and six attend day care or early schooling such as preschool, pre-kindergarten, or kindergarten, in which naps are often taken. These children are generally required to provide bedding materials such as a small pillow and children's blanket for their naps.

Children often carry their pillow separately from their blanket, often dragging the blanket on the ground. Carrying the pillow and blanket separately makes it likely that the child will misplace or confuse their pillow or blanket with other children's blanket and pillow.

Children also carry their pillow and blanket in a bag, such as a plastic grocery bag. The bag is often lost or destroyed by the child, resulting in the blanket and pillow being carried separately as discussed above.

SUMMARY OF THE INVENTION

Accordingly, a need has arisen for a children's bedding tote. The present invention provides a children's bedding tote that substantially reduces or eliminates problems associated with prior methods and systems.

In accordance with one embodiment of the present invention, a children's bedding tote is provided. The children's bedding tote comprises an aesthetically shaped tote cover comprising a handle, and a pillow disposed within the tote cover. The tote cover is also constructed to carry a children's blanket.

In a particular embodiment of the present invention, the tote cover also comprises a securable opening held closed by hook and loop fasteners. The pillow and the blanket can be inserted into or removed from the tote cover through the securable opening.

Advantages of the present invention include providing a unitary package for a child to carry their pillow and blanket. The children's tote is easily transported and reduces the possibility of misplacing either the pillow or blanket. In addition, the children's tote is aesthetically shaped which will stimulate a child's imagination. The aesthetic shape of the children's tote also allows a child to more easily identify his or her tote, decreasing the chance of confusion with other children's bedding materials.

Another advantage of the present invention is that the children's tote includes a handle which allows the tote to be easily carried. Still another advantage of the present invention is that the pillow may be removed from the tote cover to allow the pillow and tote cover to be washed separately.

Other technical advantages will be readily apparent to one skilled in the art from the following figures, descriptions, and claims.

BRIEF DESCRIPTION OF THE DRAWINGS

For a more complete understanding of the present invention and the advantages thereof, reference is now made to the following description taken in conjunction with the accompanying drawings, wherein like referenced numerals represent like parts, in which:

FIG. 1D is a rear elevation view of the children's bedding tote of FIG. 1B;

FIG. 1E is another side elevation view of the children's bedding tote of FIG. 1B;

FIG. 1F is another side elevation view of the children's bedding tote of FIG. 1B;

DETAILED DESCRIPTION OF THE INVENTION

FIGS. 1A through 8 illustrate various embodiments of a children's bedding tote. As described in greater detail below, the children's bedding tote comprises an aesthetically shaped tote cover that can carry a children's blanket, a handle, and a pillow contained within the tote cover. The children's bedding tote allows the pillow and children's blanket to be easily carried in a unitary package. A securable opening in the tote cover allows the pillow to be removed from the tote cover, for separately cleaning the pillow or the tote cover.

Figure 1A:
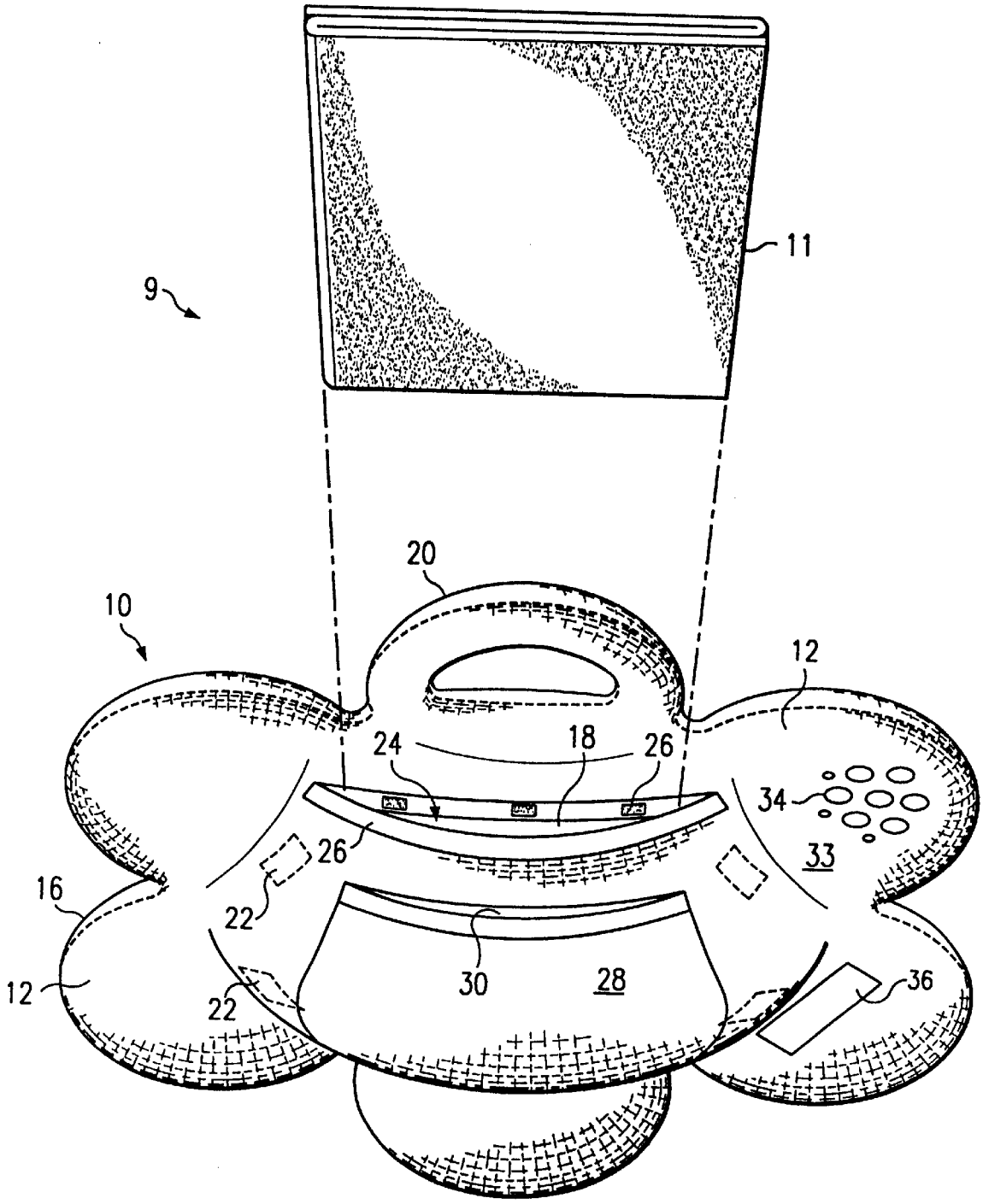
FIG. 1A is an exploded view of a children's tote package in accordance with the present invention.

FIG. 1A is an exploded view of a children's tote package 9. The children's tote package 9 comprises a children's bedding tote 10 and a children's blanket 11 operably disposed within the children's bedding tote 10. The children's blanket 11 is much smaller than a regularly sized adult blanket. For example, a typical children's blanket 11 is approximately 34 by 44 inches. In one embodiment, the children's blanket 11 has an identification tag (not expressly shown) for identification of the blanket 11. The children's blanket 11 may be constructed from any suitable fabric material, such as cotton, polyester, silk, and rayon.

The children's bedding tote 10 comprises a tote cover 12 that can carry the children's blanket 11 and has an aesthetic shape 16, a pillow 18, and a handle 20. In one embodiment, as illustrated in FIG. 1A, the handle 20 is integral with the tote cover 12. In this embodiment, the handle 20 forms a part of the aesthetic shape 16 of the tote cover 12. For example, as illustrated in FIG. 1A, the handle 20 may be a loop by which the children's bedding tote 10 may be held by hand. In another embodiment, the handle 20 may be separate from the tote cover 12. In this embodiment, the handle 20 does not form a part of the aesthetic shape 16. For example, the handle 20 may comprise backpack straps attached to the tote cover 12. It will be understood that the handle 20 may comprise any suitable device for carrying the children's bedding tote 10 without departing from the scope of the present invention.

The pillow 18 is contained within the tote cover 12. The pillow 18 has a substantially similar shape as the tote cover 12, such that the pillow 18 partially fills the tote cover 12. In one embodiment, the pillow 18 is removable from the tote cover 12. In this embodiment, the pillow 18 is generally secured to the tote cover 12 by a pillow securing device 22. The pillow securing device 22 may comprise a hook and loop type fastener, such as VELCRO™. In another embodiment, the pillow 18 is integral with the tote cover 12. In this embodiment, the pillow 18 may be a stuffing material integrated into the tote cover 12. The pillow 18 may comprise any suitable material or cushioning device, such as an inflatable pillow, without departing from the scope of the present invention.

The tote cover 12 receives both the pillow 18 and the children's blanket 11. As will be described in detail below, the pillow 18 and the children's blanket 11 may be received together or separately within the tote cover 12.

In one embodiment, as illustrated in FIG. 1A, the tote cover 12 comprises a securable opening 24 through which the pillow 18 can be removed from and inserted into the tote cover 12. The pillow 18 may be removed through the securable opening 24 in order to wash the pillow 18 or the tote cover 12 separately, or to replace the pillow 18 or the tote cover 12. In this embodiment, the securable opening 24 is held closed by a securing device 26. In one embodiment, the securing device 26 comprises a hook and loop type fastener, such as VELCRO™. In other embodiments, the securing device 26 may comprise a zipper, buttons, or any other suitable securing device without departing from the scope of the present invention.

In the embodiment illustrated in FIG. 1A, the tote cover 12 may comprise a pocket 28 for receiving the children's blanket 11. The pocket 28 may be closed by a pocket securing device 30. The pocket securing device 30 is similar to the securing device 26 discussed above. In addition, the pocket 28 may form a part of the aesthetic shape 16 of the tote cover 12. For example, a tote cover 12 having an aesthetic shape 16 of a kangaroo may have a pocket 28 in the shape of the kangaroo's pouch.

In another embodiment, the children's blanket 11 is inserted through the securable opening 24. In this embodiment, the securable opening 24 can be easily opened to remove the children's blanket 11 and then re-closed by the securing device 26 with the pillow 18 still inside the tote cover 12.

Figure 2:
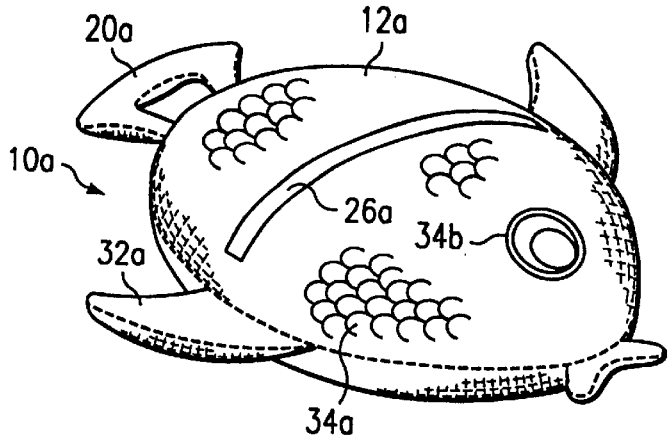
FIG. 2 is a perspective view of a children's bedding tote having an aesthetic shape of a fish in accordance with the present invention.
Figure 3:
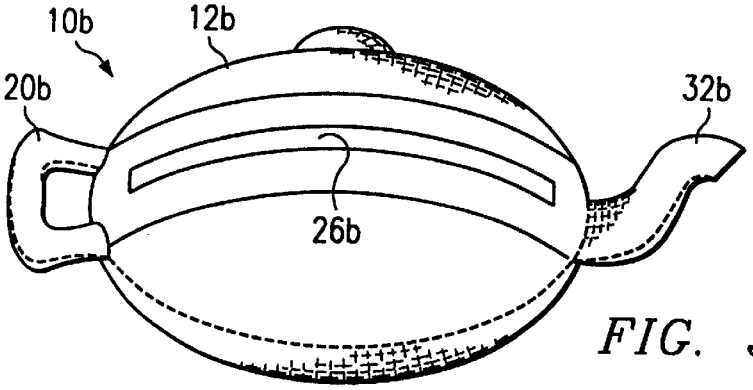
FIG. 3 is a perspective view of a children's bedding tote having an aesthetic shape of a teapot in accordance with the present invention.
Figure 4:
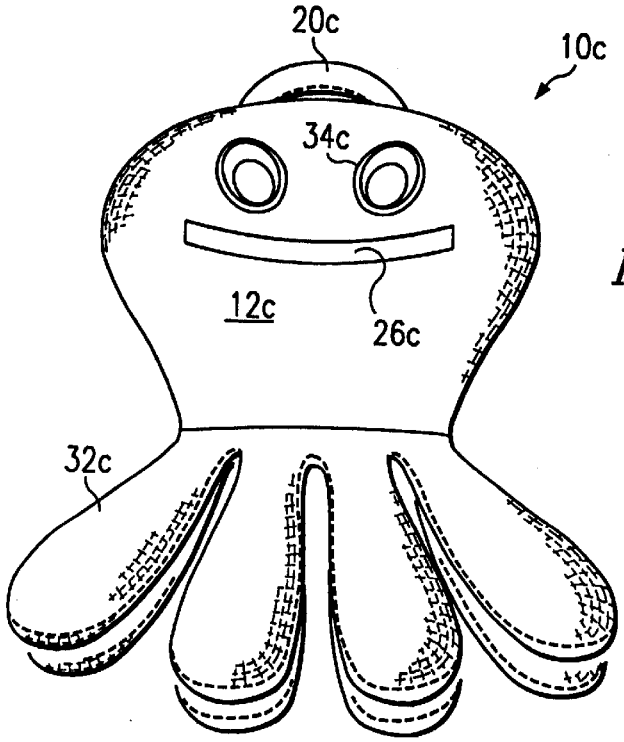
FIG. 4 is a perspective view of a children's bedding tote having an aesthetic shape of an octopus in accordance with the present invention.
Figure 5:
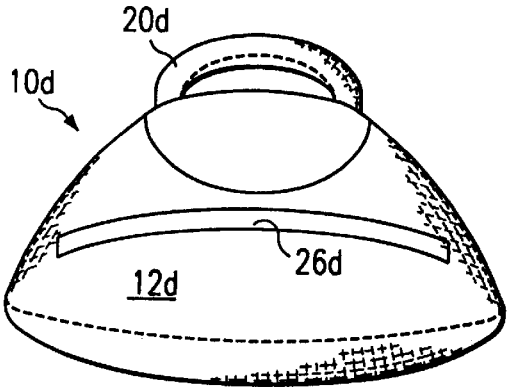
FIG. 5 is a perspective view of a children's bedding tote having an aesthetic shape of a purse in accordance with the present invention.
Figure 6:
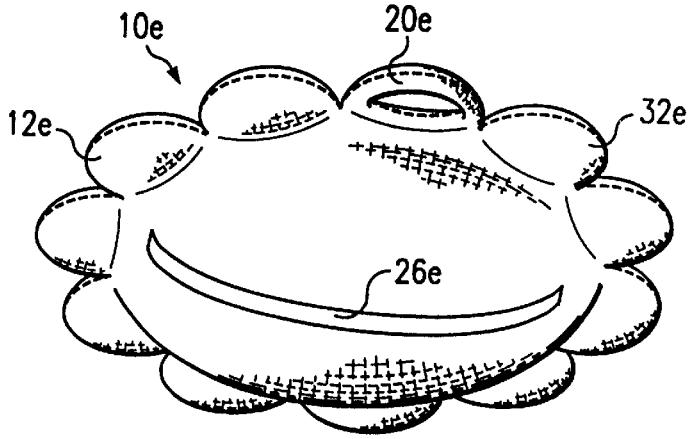
FIG. 6 is a perspective view of a children's bedding tote having an aesthetic shape of a flower in accordance with the present invention.
Figure 7:
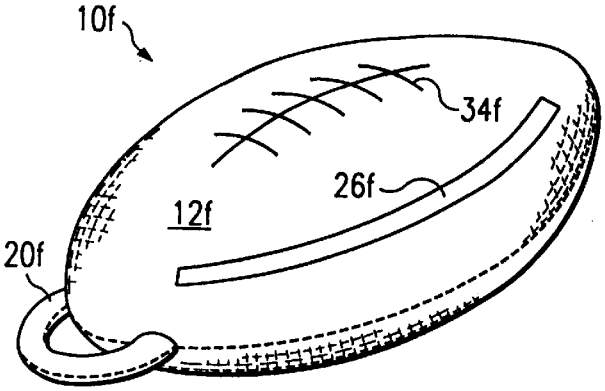
FIG. 7 is a perspective view of a children's bedding tote having an aesthetic shape of a football in accordance with the present invention.
Figure 8:
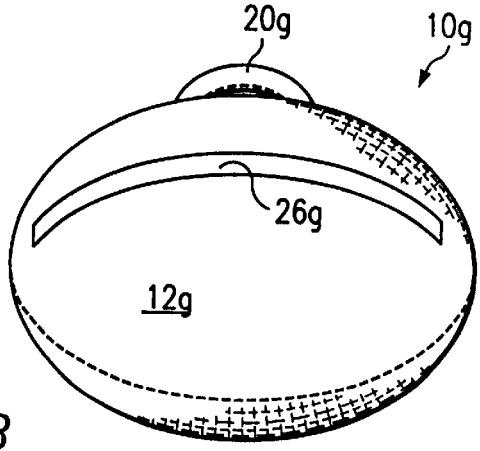
FIG. 8 is a perspective view of a children's bedding tote having an aesthetic shape of a basketball in accordance with the present invention.

Referring to FIG. 1A, the aesthetic shape 16 of the tote cover 12 forms an important and imaginative part of the children's bedding tote 10. For example, the aesthetic shape 16 may be a flower as illustrated in FIGS. 1A through 1F, an animal as illustrated in FIGS. 2 and 4, an object as illustrated in FIGS. 3 and 5, a celestial body as illustrated in FIG. 6, a sports item as illustrated in FIGS. 7 and 8, a fruit, a cartoon character, a face, or other suitable shape to which children respond. The aesthetic shape 16 of the tote cover 12 stimulates a child's imagination and also reduces the likelihood that the child will misplace or confuse his or her bedding tote 10 with other children's bedding materials.

The tote cover 12 may also comprise cover stuffing material 32 to help form the aesthetic shape 16 of the tote cover 12. The cover stuffing material 32 may be cotton, fabric material, PVC pellets, or any other suitable stuffing material. In one embodiment, the cover stuffing material 32 is integrated into particular portions of the tote cover 12 to form specific features of the aesthetic shape 16. For example, as shown in FIG. 2, cover stuffing material 32 may be integrated into portions of a tote cover 12 having an aesthetic shape 16 of a fish to form the fins of the fish. In this embodiment, the cover stuffing material 32 is sewn into the tote cover 12. It will be understood that the cover stuffing material 32 may be otherwise integrated into the tote cover 12 without departing from the present invention.

The tote cover 12 may further comprise an outer surface 33 having a design decoration 34. The design decoration 34 works in conjunction with the aesthetic shape 16 of the tote cover 12 to further stimulate the child's imagination. In one embodiment, the design decoration 34 comprises an integral color pattern in the material forming the tote cover 12. In another embodiment, the design decoration 34 is added to the outer surface 33 of the tote cover 12. For example, as shown in FIG. 2, the tote cover 12 has an aesthetic shape 16 of a fish which includes a design decoration 34 which forms eyes and scales of the fish. It will be understood that the design decoration 34 may comprise any suitable decoration without departing from the scope of the present invention.

As illustrated in FIG. 1A, the children's bedding tote 10 may also comprise an identification element 36 such that a child can easily identify his or her children's bedding tote 10. The identification element 36 may comprise a name tag on which the owner's name, telephone number, teacher, class, or other information may be written. It will be understood that the identification element 36 may comprise other means of identification without departing from the scope of the present invention.

Figure 1B:
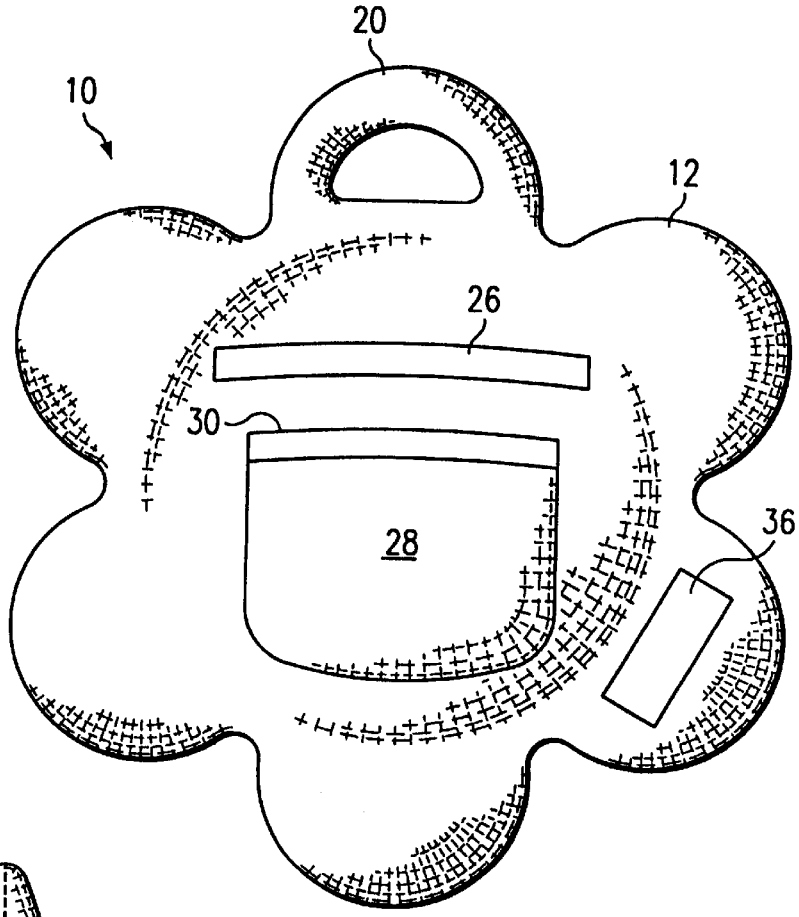
FIG. 1B is a front elevation view of the children's bedding tote in accordance with the present invention.
Figure 1C:
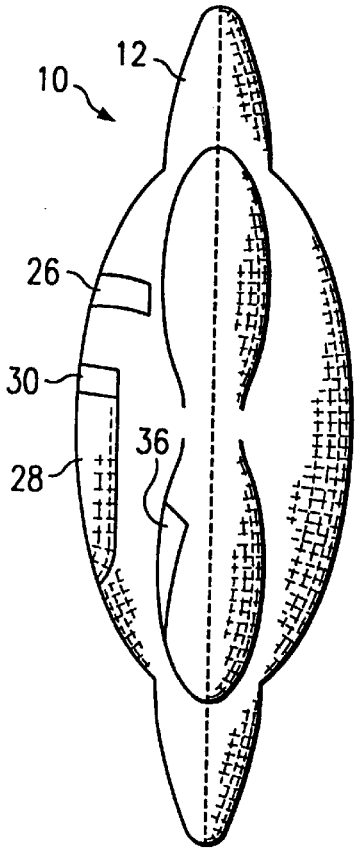
FIG. 1C is a side elevation view of the children's bedding tote of FIG. 1B.

FIGS. 1B through 1F illustrate several elevation views of the children's bedding tote 10 of FIG. 1A. In particular, FIG. 1B is a front view, FIG. 1C is a right side view, FIG. 1D is a back view, FIG. 1E is a top view, and FIG. 1F is a rotated right side view of the children's bedding tote 10.

FIGS. 2 through 8 illustrate various embodiments of a children's bedding tote 10 having various aesthetic shapes 16. Specifically, FIG. 2 is a perspective view of a children's bedding tote 10*a* having an aesthetic shape 16*a* of a fish. FIG. 3 is a perspective view of a children's bedding tote 10*b* having an aesthetic shape 16*b* of a teapot. FIG. 4 is a perspective view of a children's bedding tote 10*c* having an aesthetic shape 16*c* of an octopus. FIG. 5 is a perspective view of a children's bedding tote 10*d* having an aesthetic shape 16*d* of a purse. FIG. 6 is a perspective view of a children's bedding tote 10*e* having an aesthetic shape 16*e* of a flower. FIG. 7 is a perspective view of a children's bedding tote 10*f* having an aesthetic shape 16*f* of a football. FIG. 8 is a perspective view of a children's bedding tote 10*g* having an aesthetic shape 16*g* of a basketball.

Although the present invention has been described with reference to several specific embodiments, various changes and modifications may be suggested to one skilled in the art. It is intended that the present invention encompass such changes and modifications that fall within the scope of the invention which is solely defined by the appended claims.

What is claimed is:

1. A children's bedding tote operable to be carried by a child, the children's bedding tote comprising:

an aesthetically shaped tote cover comprising a cavity operable to receive a pillow and a pocket operable to receive a children's blanket;

a removable pillow securably disposed within the cavity of the tote cover;

a closed loop handle attached to the tote cover; and a separate and removable children's blanket disposed within the pocket of the tote cover.

2. The children's bedding tote of claim 1, wherein the tote cover further comprises a securable opening for removal of the pillow.

3. The children's bedding tote of claim 2, wherein the securable opening is held closed by hook and loop fasteners.

4. The children's bedding tote of claim 1, wherein the pillow comprises a shape substantially the same as the tote cover.

5. The children's bedding tote of claim 1, wherein the aesthetic shape of the tote cover is selected from the group consisting of an animal, a flower, a fruit, a character, a face, or an object.

6. The children's bedding tote of claim 1, wherein the tote cover further comprises an outer surface having a design decoration.

7. The children's bedding tote of claim 1, wherein the tote cover further comprises an identification element.

8. A children's tote package operable to be carried by a child, the children's tote package comprising:

an aesthetically shaped tote cover comprising a cavity operable to receive a pillow and a pocket operable to receive a children's blanket;

a removable pillow securably disposed within the cavity of the tote cover;

a separate and-removable children's blanket operable to be disposed within the pocket of the tote cover; and a closed loop handle coupled to the tote cover.

9. The children's tote package of claim 8, wherein the tote cover further comprises a securable opening for removal of the pillow.

10. The children's tote package of claim 9, wherein the securable opening is held closed by hook and loop fasteners.

11. The children's tote package of claim 8, wherein the pillow comprises a shape substantially the same as the tote cover.

12. The children's tote package of claim 8, wherein the aesthetic shape of the tote cover is selected from the group consisting of an animal, a flower, a fruit, a character, a face, or an object.

13. The children's tote package of claim 8, wherein the tote cover comprises an outer surface having a design decoration.

14. The children's tote package of claim 8, wherein the tote cover further comprises an identification element.

* * * * *